US009915127B1

(12) United States Patent
Hoffman

(10) Patent No.: US 9,915,127 B1
(45) Date of Patent: Mar. 13, 2018

(54) FLOW BALANCED FRAC TANK FARM

(71) Applicant: Hydra Heating Industries, LLC, Atlanta, GA (US)

(72) Inventor: Michael Hoffman, Foley, AL (US)

(73) Assignee: Hydra Heating Industries, LLC, Atlanta, GA (US)

( * ) Notice: Subject to any disclaimer, the term of this patent is extended or adjusted under 35 U.S.C. 154(b) by 0 days.

(21) Appl. No.: 14/996,699

(22) Filed: Jan. 15, 2016

Related U.S. Application Data

(60) Provisional application No. 62/104,453, filed on Jan. 16, 2015.

(51) Int. Cl.

| | |
|---|---|
| ***E21B 36/00*** | (2006.01) |
| ***F24H 1/12*** | (2006.01) |
| ***B65D 88/12*** | (2006.01) |
| ***B65D 90/16*** | (2006.01) |
| ***B65D 88/30*** | (2006.01) |
| ***E21B 41/00*** | (2006.01) |

(52) U.S. Cl.
CPC ..... *E21B 36/006* (2013.01); *B65D 88/128* (2013.01); *B65D 88/30* (2013.01); *B65D 90/16* (2013.01); *E21B 41/00* (2013.01); *F24H 1/125* (2013.01); *Y10T 137/4673* (2015.04); *Y10T 137/4807* (2015.04); *Y10T 137/4857* (2015.04); *Y10T 137/4874* (2015.04); *Y10T 137/6416* (2015.04); *Y10T 137/6855* (2015.04); *Y10T 137/85954* (2015.04); *Y10T 137/86292* (2015.04); *Y10T 137/86324* (2015.04)

(58) Field of Classification Search
CPC ..... Y10T 137/4857; Y10T 137/4874; Y10T 137/86292; Y10T 137/86324; Y10T 137/6855; Y10T 137/4673; Y10T 137/4807; Y10T 137/6416; Y10T 137/85954; B65D 90/16; B65D 88/128; B65D 88/30; F24H 1/125; E21B 41/00; E21B 36/006
See application file for complete search history.

(56) References Cited

U.S. PATENT DOCUMENTS 5,656,136 A * 8/1997 Gayaut ..... E21B 33/068 166/302
8,905,056 B2 12/2014 Kendrick
9,650,871 B2 5/2017 Oehring
(Continued)

OTHER PUBLICATIONS

Non-Final Office Action dated Aug. 25, 2017 (U.S. Appl. 15/045,972).

*Primary Examiner* — Atif Chaudry
(74) *Attorney, Agent, or Firm* — Thomas Horstemeyer, LLP

(57) ABSTRACT

Aspects of a flow balanced frac tank farm are described herein. In one embodiment, the flow balanced frac tank farm includes at least one battery of frac tanks comprising a plurality of frac tank trailers, a header pipe arrangement, and at least one valve between one or more of the frac tank trailers and the header system. The header pipe arrangement may include a header supply pipe to supply water to individual ones of the plurality of frac tank trailers and a header discharge pipe to discharge water from individual ones of the plurality of frac tank trailers. The header pipe arrangement may be relied upon to help balance the flow of heated fluids among the frac tank trailers in frac tank farm.

12 Claims, 10 Drawing Sheets

(56) References Cited

U.S. PATENT DOCUMENTS

| | | | | |
|---|---|---|---|---|
| 2009/0029879 | A1* | 1/2009 | Soni | E21B 43/16 507/201 |
| 2010/0059226 | A1 | 3/2010 | Termine | |
| 2011/0137465 | A1 | 6/2011 | Angelilli et al. | |
| 2012/0118397 | A1 | 5/2012 | Novotny | |
| 2012/0181015 | A1* | 7/2012 | Kajaria | E21B 43/26 166/177.5 |
| 2013/0299167 | A1* | 11/2013 | Fordyce | E21B 43/267 166/280.1 |
| 2014/0026824 | A1* | 1/2014 | Romocki | E21B 43/26 122/31.1 |
| 2015/0129210 | A1 | 5/2015 | Chong | |
| 2015/0144336 | A1* | 5/2015 | Hardin | E21B 44/00 166/250.01 |
| 2016/0059764 | A1* | 3/2016 | Hamm | B60P 3/2215 280/837 |
| 2016/0060148 | A1 | 3/2016 | Mason | |
| 2016/0105022 | A1 | 4/2016 | Oehring | |
| 2016/0319650 | A1 | 11/2016 | Oehring | |

* cited by examiner

FLOW BALANCED FRAC TANK FARM

CROSS-REFERENCE TO RELATED APPLICATIONS

This application claims the benefit of U.S. Provisional Application Ser. No. 62/104,453, filed Jan. 16, 2015, the entire contents of which are hereby incorporated herein by reference.

BACKGROUND

One or more fluid storage tanks, such as frac or trailer tanks, may be used to provide storage for fluid at various locations, such as at drilling sites for oil wells, gas wells, manufacturing facilities, warehouses, user facilities (e.g., biodiesel storage for farms), trans loading facilities, municipal and public works locations, etc. In this context, a frac tank may be towed to a temporary location by a tow vehicle. At the drilling site, the frac tank may be unhooked from the tow vehicle and positioned at a suitable location to be filled with fluid. When positioned at the suitable position on stable ground, the frac tank can be filled with fluid for storage and dispensing. Other types of tanks may be stationary, in ground, above ground, round, rectangular or square.

BRIEF DESCRIPTION OF THE DRAWINGS

Aspects of the present disclosure can be better understood with reference to the following drawings. It is noted that the elements in the drawings are not necessarily to scale, with emphasis instead being placed upon clearly illustrating the principles of the embodiments. In the drawings, like reference numerals designate like or corresponding, but not necessarily the same, elements throughout the several views.

DETAILED DESCRIPTION

As noted above, frac tanks may be used to provide storage for fluid at various locations, such as drilling sites for oil and gas wells, for example. When located and positioned at a suitable position, a frac tank can be filled with fluid for storage and dispensing. Examples of fluids that may be stored in frac tanks include fracking liquids, drilling mud, fluids from environmental cleanup, water, brine, etc. As used herein, the term "fluid" includes any material or composition of materials of suitable viscosity to flow through pipes or tubes and into and out of a storage tank, with or without pumping. Thus, the term "fluid" is intended to include any flowing mixture, suspension, or slurry, regardless of materials.

Depending upon the needs at the site, the volume of fluid held by a single frac tank may be insufficient. For example, the volume of fluid held by a single frac tank trailer, positioned at a suitable location by a tractor, may be insufficient for certain jobs. Further, larger solutions, such as frac pools, may be unsuitable, undesirable, or unavailable for various reasons. In this case, according to the embodiments described herein, a group of frac tank trailers may be arranged together in one or more batteries of frac tanks to form a frac tank farm.

It may also be desirable or necessary to heat the fluid stored in a frac tank. For example, in hydraulic fracturing, heated fluid is pumped into wells to stimulate the removal of oil and/or gas deposits. In the case of a frac tank farm, it may be relatively difficult to evenly disperse or diffuse heated fluid throughout the frac tank trailers in the frac tank farm. Thus, according to the embodiments described herein, a header pipe arrangement may be relied upon to help balance the flow of heated fluids among the frac tank trailers in frac tank farm.

In the context outlined above, aspects of a flow balanced frac tank farm are described herein. In one embodiment, the flow balanced frac tank farm includes at least one battery of frac tanks comprising a plurality of frac tank trailers, a header pipe arrangement, and at least one valve between one or more of the frac tank trailers and the header system. The header pipe arrangement may include a header supply pipe to supply water to individual ones of the plurality of frac tank trailers and a header discharge pipe to discharge water from individual ones of the plurality of frac tank trailers. The header pipe arrangement may be relied upon to help balance the flow of heated fluids among the frac tank trailers in frac tank farm. In various embodiments, the balance of the flow may or may not be augmented by valves, restrictive orifices, pumps, or headers. Also, depending upon the terrain, additional augmentation using valves, restrictive orifices, pumps, or headers may be relied upon.

Turning now to the drawings, various structural and functional aspects of the embodiments are described in further detail.

Figure 1A:
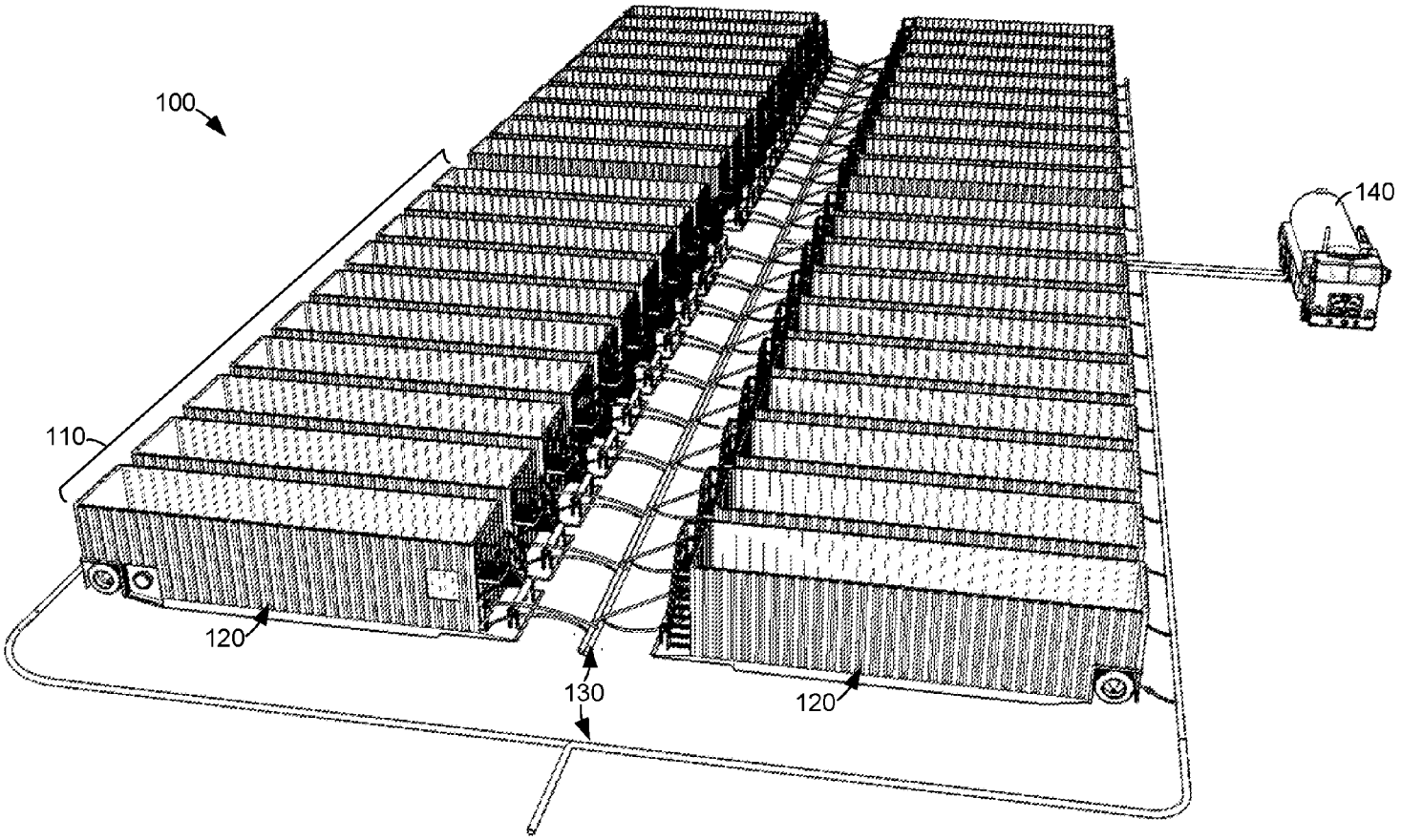
FIG. 1A illustrates a perspective view of an example flow balanced frac tank farm according to one embodiment of the present disclosure.
Figure 1B:
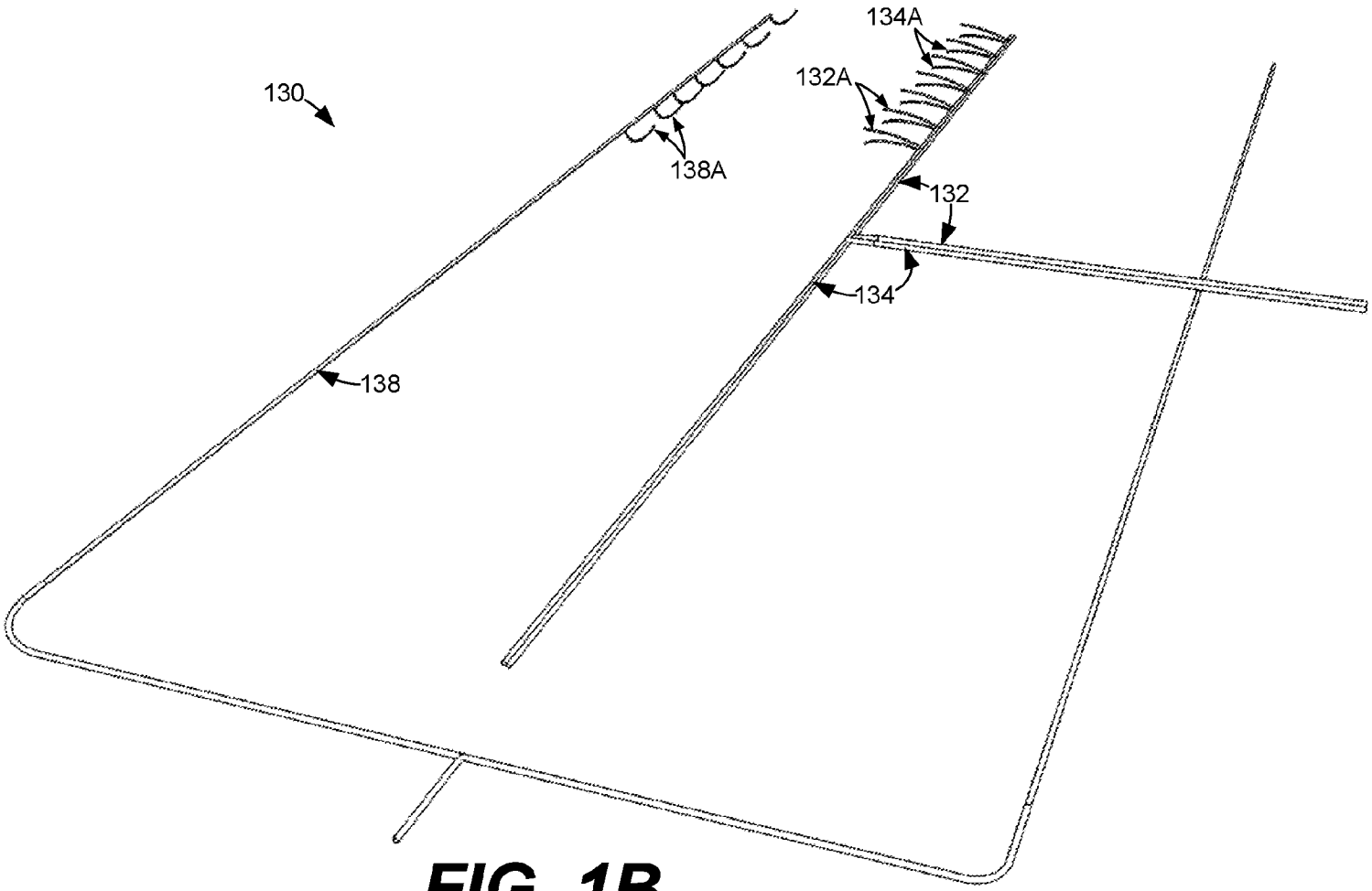
FIG. 1B illustrates a perspective view of an example header pipe arrangement according to one embodiment of the present disclosure.

FIG. 1 illustrates a perspective view of an example flow balanced frac tank farm 100 according to one embodiment of the present disclosure. It should be appreciated that frac tank farm 100 in FIG. 1 is provided by way of example only. In other words, the embodiments frac tank farms described herein may be arranged in other configurations.

As illustrated in FIG. 1, the frac tank farm 100 includes four batteries 110 of frac tank trailers 120, arranged in two rows. In FIG. 1, each battery 110 includes ten frac tank trailers 120, for a total of forty frac tank trailers 120 in the frac tank farm 100, although any battery 110 may include a lesser or greater number of frac tank trailers 120 among embodiments. The frac tank farm 100 also includes a header pipe arrangement 130. Among other components, the header pipe arrangement 130 includes at least one header supply pipe to supply water to individual ones of the frac tank trailers 120 and at least one header discharge pipe to discharge water from individual ones of the frac tank trailers 120. The header pipe arrangement 130 is designed to balance the flow of fluid relatively evenly among the frac tank trailers 120 in the frac tank farm 100. Particularly when fluid in the frac tank trailers 120 is being heated and exchanged, the header pipe arrangement 130 is designed to balance the flow of heated fluid relatively evenly among the frac tank trailers 120, so as to achieve a substantially evenly heated temperature of fluid among the frac tank trailers 120. In the embodiment illustrated in FIG. 1, the head ends of the frac tank trailers 120 are facing each other ("head-to-head") along the central column 136 (FIG. 2) of the header pipe arrangement 130. The tail ends of the frac tank trailers 120, having wheels, are further apart from each other.

To heat the fluid in the frac tank farm 100, a heater truck 140 may be relied upon. The header pipe arrangement 130 may be installed or otherwise connected for fluid communication between the frac tank trailers 120 in the frac tank farm 100 and the heater truck 140. In this configuration, fluid may be discharged from the frac tank trailers 120, routed to the heater truck 140 for heating by the header pipe arrangement 130, and returned to the frac tank trailers 120 by the header pipe arrangement 130. Thus, in one configuration, the header pipe arrangement 130 provides a closed fluid loop between the frac tank trailers 120 in the frac tank farm 100 and the heater truck 140. The heater truck 140 may be capable of generating an amount of energy, measured in British Thermal Units (BTUs), for example, to heat the fluid from the frac tank trailers 120. Depending upon the desired temperature and other factors, the heater truck 140 may be selected to provide ten or more million BTUs for each battery 110 of ten frac tank trailers 120, although other suitable ratios of BTUs to tanks may be relied upon.

Each frac tank trailer 120 includes a storage tank and wheels. A frac tank trailer 120 may be formed from steel or any other material suitable for the application. The walls of the frac tank trailer 120 may be formed from corrugated steel plate, pig iron, plastic or other materials, formed into a rectangular tank structure, and welded along one edge to the tank base. Inside the walls, a liner for the storage tank may or may not be relied upon to separate or insulate the storage tank from the walls, as some tanks are single walled. Generally, the wheels of the frac tank trailer 120 may be relied upon to transport and position the frac tank trailer 120 to any suitable location using a tractor, for example.

In some embodiments, one or more of the frac tank trailers 120 may include an exchanger to help disperse fluid relatively evenly over its storage tank. One example of such an exchanger is described in U.S. Non-provisional patent application Ser. No. 14/526,204, filed Oct. 28, 2014, and titled "Frac and Storage Tank Exchanger."

FIG. 1A illustrates a perspective view of the header pipe arrangement 130 in FIG. 1. As shown in FIG. 1A, the header pipe arrangement 130 includes a header supply pipe 132 to supply water to individual ones of the plurality of frac tank trailers 120 (FIG. 1) and a header discharge pipe 134 to discharge water from individual ones of the plurality of frac tank trailers 120 (FIG. 1). The header supply pipe 132 and header discharge pipe 134 provide a closed fluid loop between the frac tank trailers 120 in the frac tank farm 100 and the heater truck 140 (FIG. 1), for example. Specifically, fluid may be routed from the frac tank trailers 120 to the heater truck 140 for heating through the header discharge pipe 134 and returned to the frac tank trailers 120 through the header supply pipe 132.

Header supply tubes 132A branch off the header supply pipe 132 and supply water to individual ones of the frac tank trailers 120. Similarly, discharge supply tubes 134A branch off the header discharge pipe 134 to discharge water from individual ones of the frac tank trailers 120. In one embodiment, the lengths of the header supply tubes 132A are similar to (e.g., the same or nearly the same as) those of the discharge supply tubes 134A, although different lengths may be relied upon. In some embodiments, valves may be placed in one or more of the header supply tubes 132A or the discharge supply tubes 134A to control the flow of fluids into or out of the individual ones of the frac tank trailers 120.

The header supply tubes 132A may be evenly spaced and connected along the central column 136 (FIG. 2) of the header supply pipe 132 in one embodiment, although any suitable spacing may be used, as needed, depending upon the positions of the frac tank trailers 120, for example. First ends of the header supply tubes 132A may be connected with the header supply pipe 132 using tee joints or other suitable fittings or attachment means. Second ends of the header supply tubes 132A may be connected to one or more fluid input or intake ports or manifolds at the head of the frac tank trailers 120 (see also, e.g., FIG. 3). In some embodiments, the volume of fluid provided through the header supply tubes 132A may be pressure and/or volume balanced along the central column 136 of the header supply pipe 132 to allow balanced flow to the frac tank trailers 120. Connections to the header supply pipe 132 may be calculated or determined empirically for balanced or desired flow among each of the header supply tubes 132A. Also, the positions and inclination/declination of each connection to the header supply pipe 132 may be relied upon as a restrictive orifice. In this context, smaller or larger openings and hoses may be relied upon to augment the balance of the flow.

The discharge supply tubes 134A may also be evenly spaced and connected along the central column of the discharge supply pipe 134 in one embodiment, although any suitable spacing may be used, as needed, depending upon the positions of the frac tank trailers 120, for example. First ends of the discharge supply tubes 134A may be connected with the discharge supply pipe 134 using tee joints or other suitable fittings or attachment means. Second ends of the discharge supply tubes 134A may be connected to one or more fluid output ports or manifolds at the head of the frac tank trailers 120. In some embodiments, the volume of fluid provided through the discharge supply tubes 134A may be pressure and/or volume balanced along the central column 136 of the discharge supply pipe 134 to allow even flow from the frac tank trailers 120. In some embodiments, valves may be placed in one or more of the discharge supply tubes 134A to control the flow of fluids out of the individual ones of the frac tank trailers 120. Connections to the discharge supply pipe 134 may be calculated or determined empirically for balanced or desired flow among each of the discharge supply tubes 134A. Also, the positions and inclination/declination of each connection to the discharge supply pipe 134 may be relied upon as a restrictive orifice. In this context, smaller or larger openings and hoses may be relied upon to augment the balance of the flow.

As also shown in FIG. 1A, the header pipe arrangement 130 includes a drain pipe 138 and drain supply tubes 138A which branch off the drain pipe 138. The drain pipe 138 may be relied upon as an alternative way to discharge or drain fluid from the frac tank trailers 120. The drain supply tubes 138A may be connected to one or more fluid output ports or manifolds at a tail of the frac tank trailers 120.

It is noted that, in various embodiments, the header pipe arrangement 130 may be embodied by any suitable type or types of pipes or tubes formed from any suitable material, such as metal, metal alloys, plastic, etc. The header pipe arrangement 130 may be constructed using several different parts, pieces, and/or lengths of pipes or tubes, and associated fittings, as needed, based on the configuration and size of the frac tank farm 100. In some embodiments, the header pipe arrangement 130 may be insulated, at least in part, to help prevent the loss of heat from the fluid in the header pipe arrangement 130.

Figure 2:
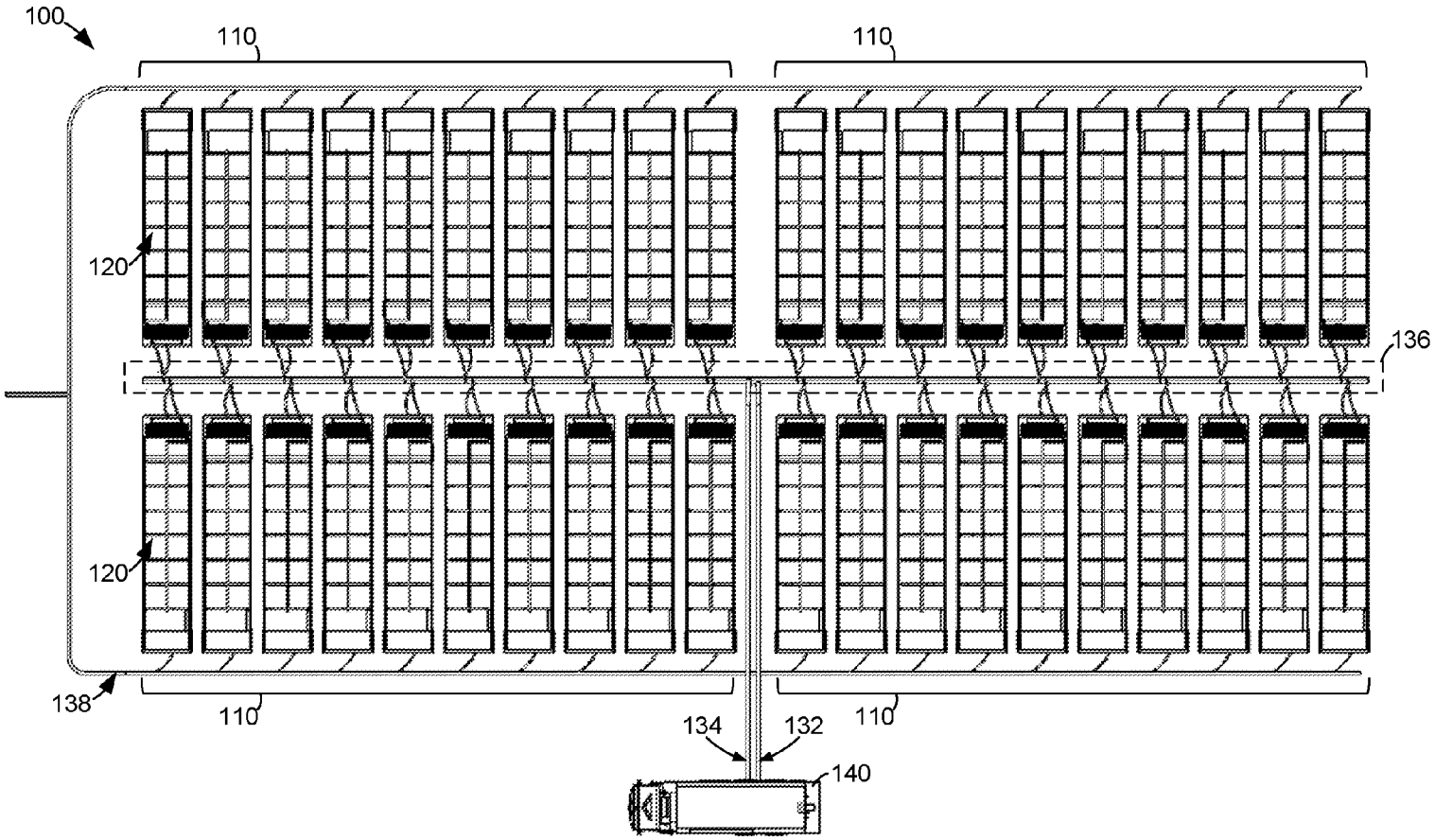
FIG. 2 illustrates a top-down view of the flow balanced frac tank farm in FIG. 1 according to one embodiment of the present disclosure.

FIG. 2 illustrates a top-down view of the flow balanced frac tank farm 100 in FIG. 1 according to one embodiment of the present disclosure. In the view provided in FIG. 2, it is clear how the header supply pipe 132 and the header discharge pipe 134 are routed from the heater truck 140 and centrally between two of the batteries 110 in one row before branching off to the central column 136 of the header pipe arrangement 130. By centrally positioning parts of the header pipe arrangement 130 among the frac tank trailers 120 in the frac tank farm 100, a more balanced and/or even supply of heated fluids may be exchanged among the frac tank trailers 120. Similarly, a balanced and/or even supply of heated fluids may be drained from the frac tank trailers 120 using drain pipe 138.

Figure 3:
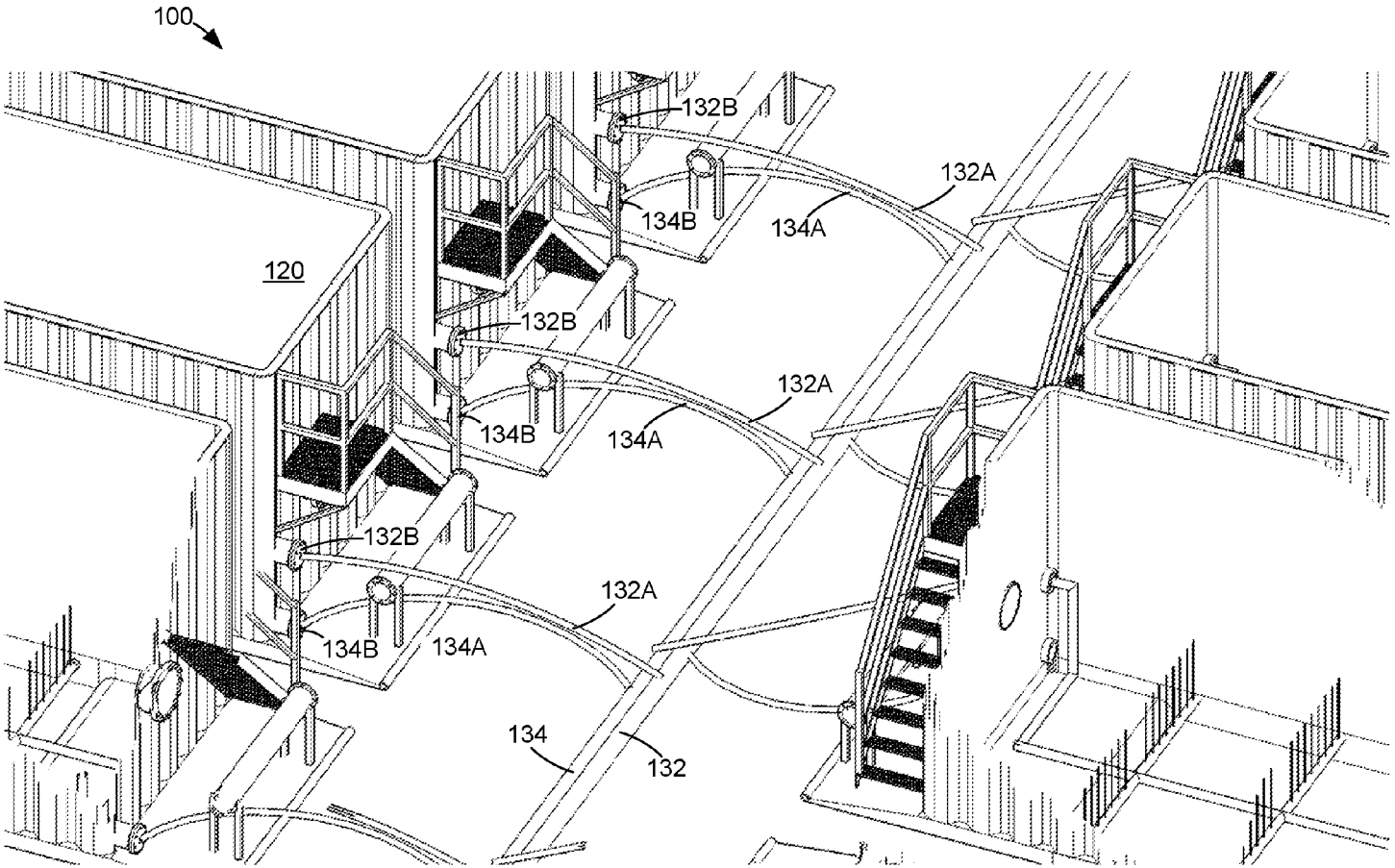
FIG. 3 illustrates a perspective view of part of a header pipe arrangement in the flow balanced frac tank farm in FIG. 1 according to one embodiment of the present disclosure.

FIG. 3 illustrates a perspective view of part of a header pipe arrangement 130 in the flow balanced frac tank farm in FIG. 1 according to one embodiment of the present disclosure. In FIG. 3, the header supply tubes 132A and the discharge supply tubes 134A can be more easily seen extending from the header supply pipe 132 and the discharge supply pipe 134, respectively, to the individual ones of the frac tank trailers 120. As shown, the header supply tubes 132A may be evenly spaced and connected along the header supply pipe 132. First ends of the header supply tubes 132A may be connected with the header supply pipe 132 using tee joints or other suitable fittings or attachment means. Second ends of the header supply tubes 132A may be connected to one or more fluid input or intake ports or manifolds 132B at the head of the frac tank trailers 120.

The discharge supply tubes 134A may also be evenly spaced and connected along the discharge supply pipe 134, as illustrated. First ends of the discharge supply tubes 134A may be connected with the discharge supply pipe 134 using tee joints or other suitable fittings or attachment means. Second ends of the discharge supply tubes 134A may be connected to one or more fluid output ports or manifolds 134B at the head of the frac tank trailers 120. In some embodiments, valves may be placed in one or more of the discharge supply tubes 134A to control the flow of fluids out of the individual ones of the frac tank trailers 120.

Figure 4:
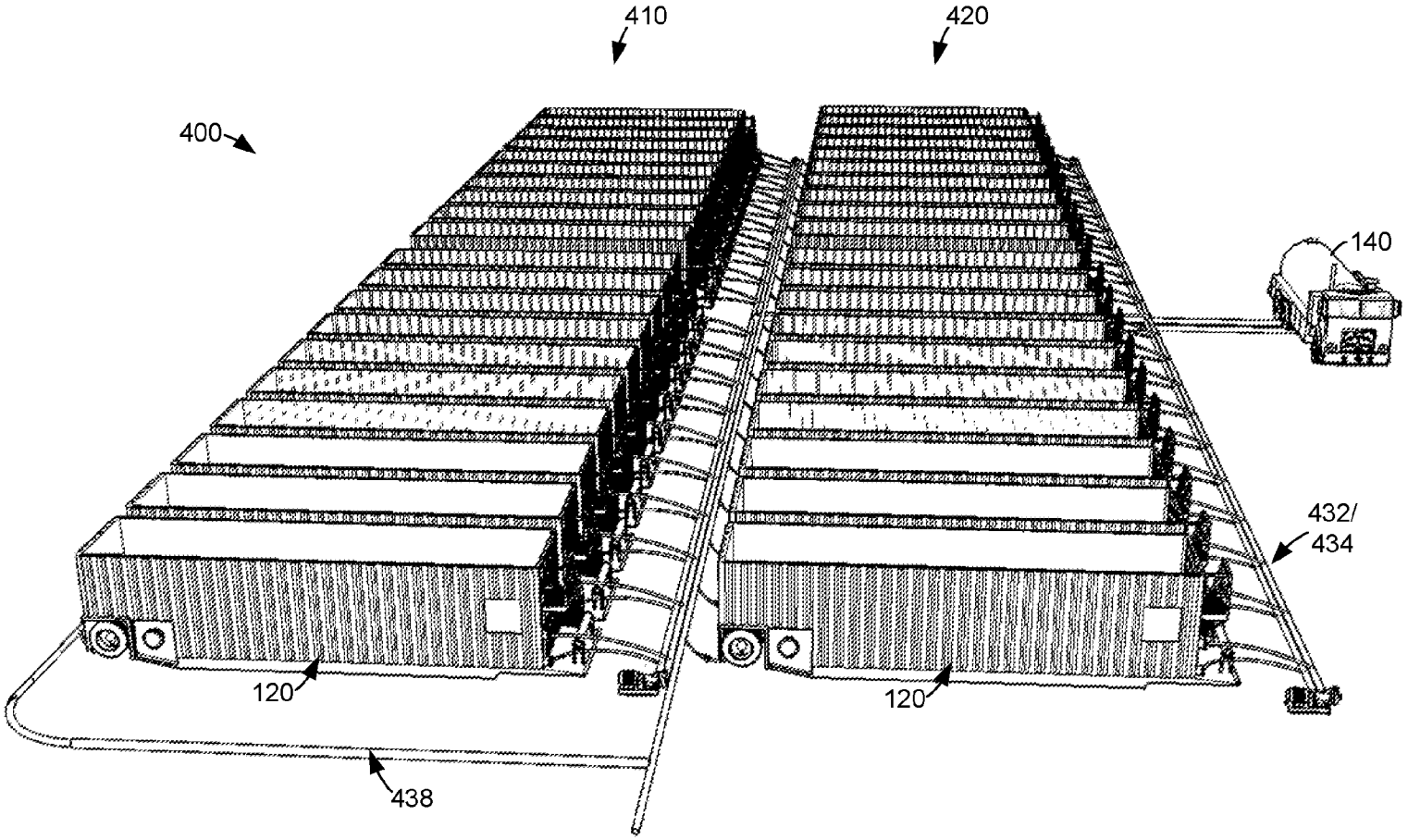
FIG. 4 illustrates a perspective view of an example flow balanced frac tank farm according to another embodiment of the present disclosure.

FIG. 4 illustrates a perspective view of an example flow balanced frac tank farm 400 according to another embodiment of the present disclosure. In the embodiment illustrated in FIG. 4, the head ends of the first row 410 of the frac tank trailers 120 are facing the tail ends of the second row 420 of the frac tank trailers 120 ("head-to-tail"). This configuration may be easier to arrange, especially if the frac tank trailers 120 are delivered and positioned by semi tractors. As compared to the arrangement of the header supply pipe 132 and the header discharge pipe 134 in FIGS. 1, 1A, 2, and 3, the header supply pipe 432 and the header discharge pipe 434 in FIG. 4 run in two columns rather than one, due to the "head-to-tail" arrangement of the frac tank trailers 120. Similarly, as compared to the drain pipe 138 (FIG. 1), the drain pipe 438 is arranged in an alternative way due to the "head-to-tail" arrangement of the frac tank trailers 120.

Figure 5:
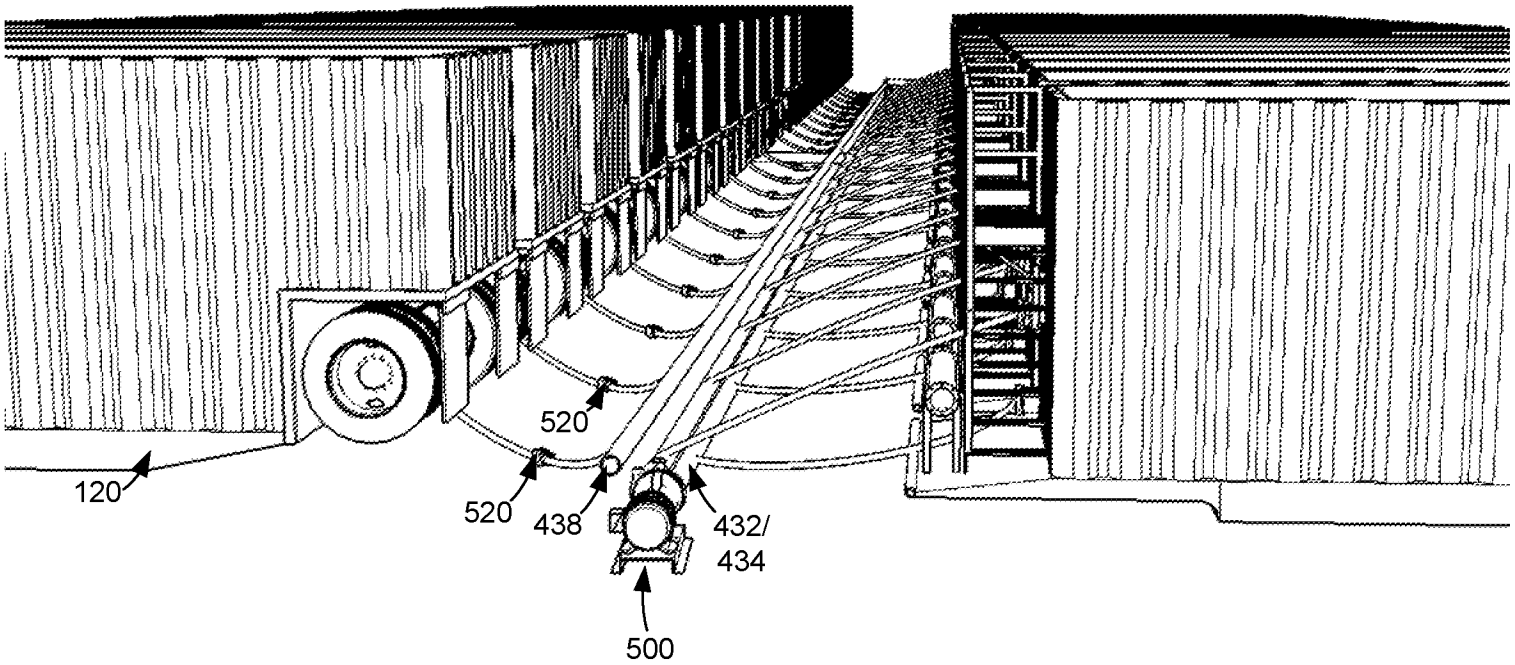
FIG. 5 illustrates a perspective view of part of a header pipe arrangement in the flow balanced frac tank farm in FIG. 4 according to one embodiment of the present disclosure.

FIG. 5 illustrates a perspective view of part of the flow balanced frac tank farm 400 in FIG. 4 according to one embodiment of the present disclosure. In addition to the header supply pipe 432, the header discharge pipe 434, and the drain pipe 438, FIG. 4 illustrates a pump 500 between the header supply pipe 432 and the header discharge pipe 434. The pump 500 may be relied upon to assist with the flow of fluid between the frac tank trailers 120 and the heater truck 140. The pump 500 may be embodied as any suitable size or style pump, depending upon the viscosity of the fluid in the frac tank trailers 120 and other factors. In FIG. 5, valves 420 are also shown between the frac tank trailers 120 and the drain pipe 438. It should be appreciated that valves, similar to valve 420, may be relied upon in various locations between any header pipes and the frac tank trailers 120 or in the header pipes themselves.

Figure 6:
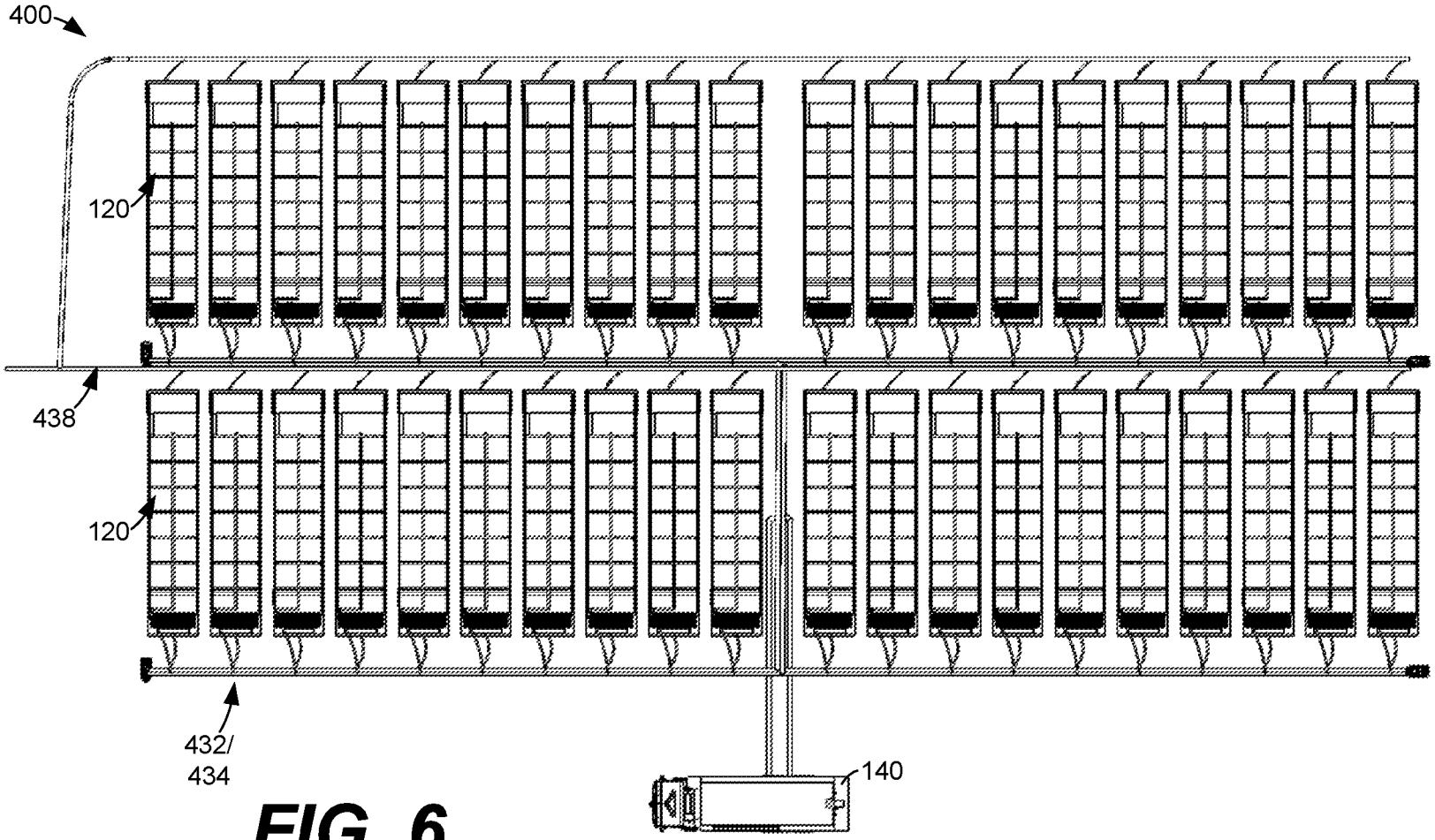
FIG. 6 illustrates a top-down view of the flow balanced frac tank farm in FIG. 4 according to another embodiment of the present disclosure.

FIG. 6 illustrates a top-down view of the flow balanced frac tank farm 400 in FIG. 4 according to another embodiment of the present disclosure. In the view provided in FIG. 6, it is clear how the header supply pipe 432, the header discharge pipe 434, and the drain pipe 438 are routed from the heater truck 140 to the frac tank trailers 120.

Figure 7:
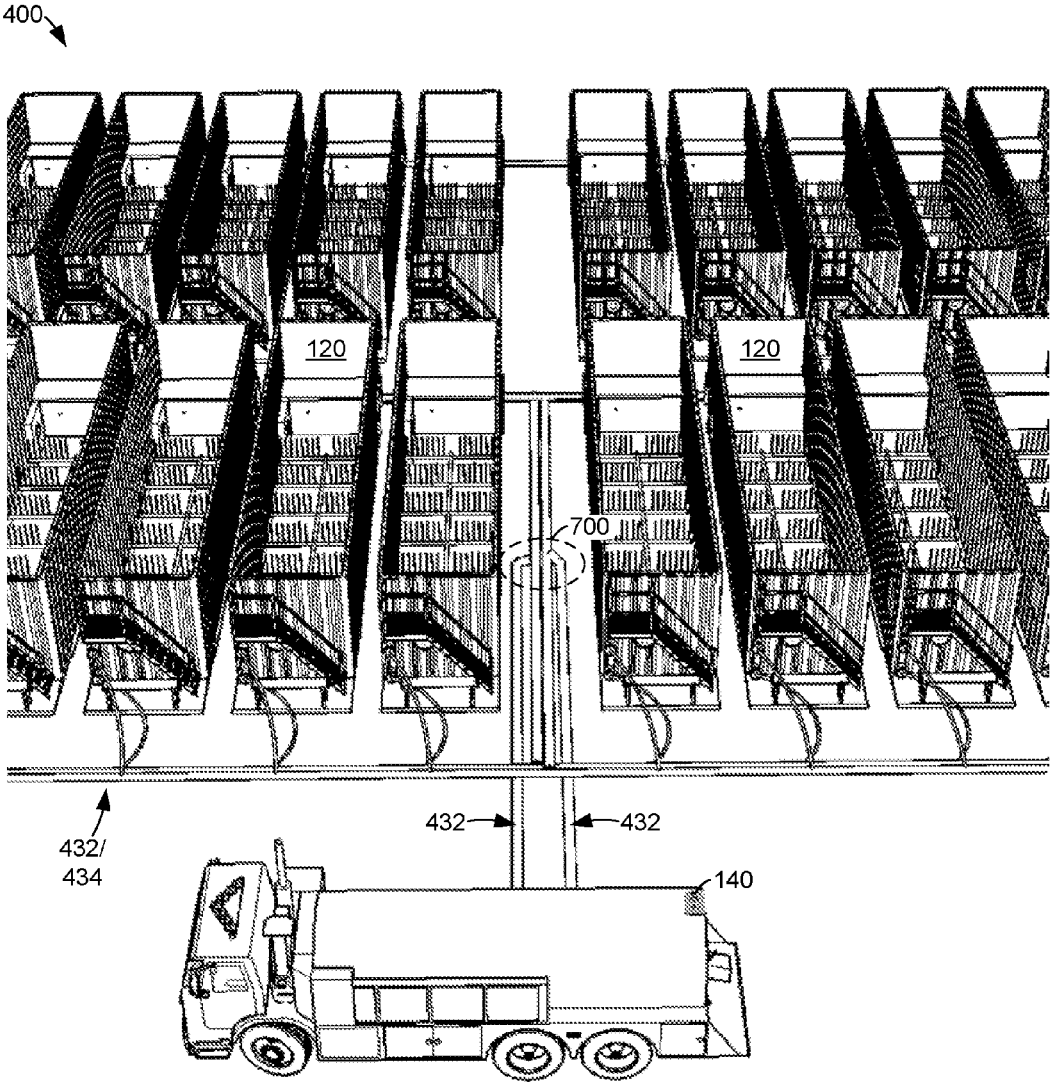
FIG. 7 illustrates a perspective view of another part of the header pipe arrangement in the flow balanced frac tank farm in FIG. 4 according to one embodiment of the present disclosure.

FIG. 7 illustrates a perspective view of the flow balanced frac tank farm 400 in FIG. 4 according to one embodiment of the present disclosure. In FIG. 7, the header supply pipe 432 and the header discharge pipe 434 run from the heater truck 140 to a center split 700, before being routed along the head ends of the frac tank trailers 120. By making the center split 700 substantially in the middle of the header pipes, the temperature of the fluid that flows among the frac tank trailers 120 may be substantially uniform.

Figure 8:
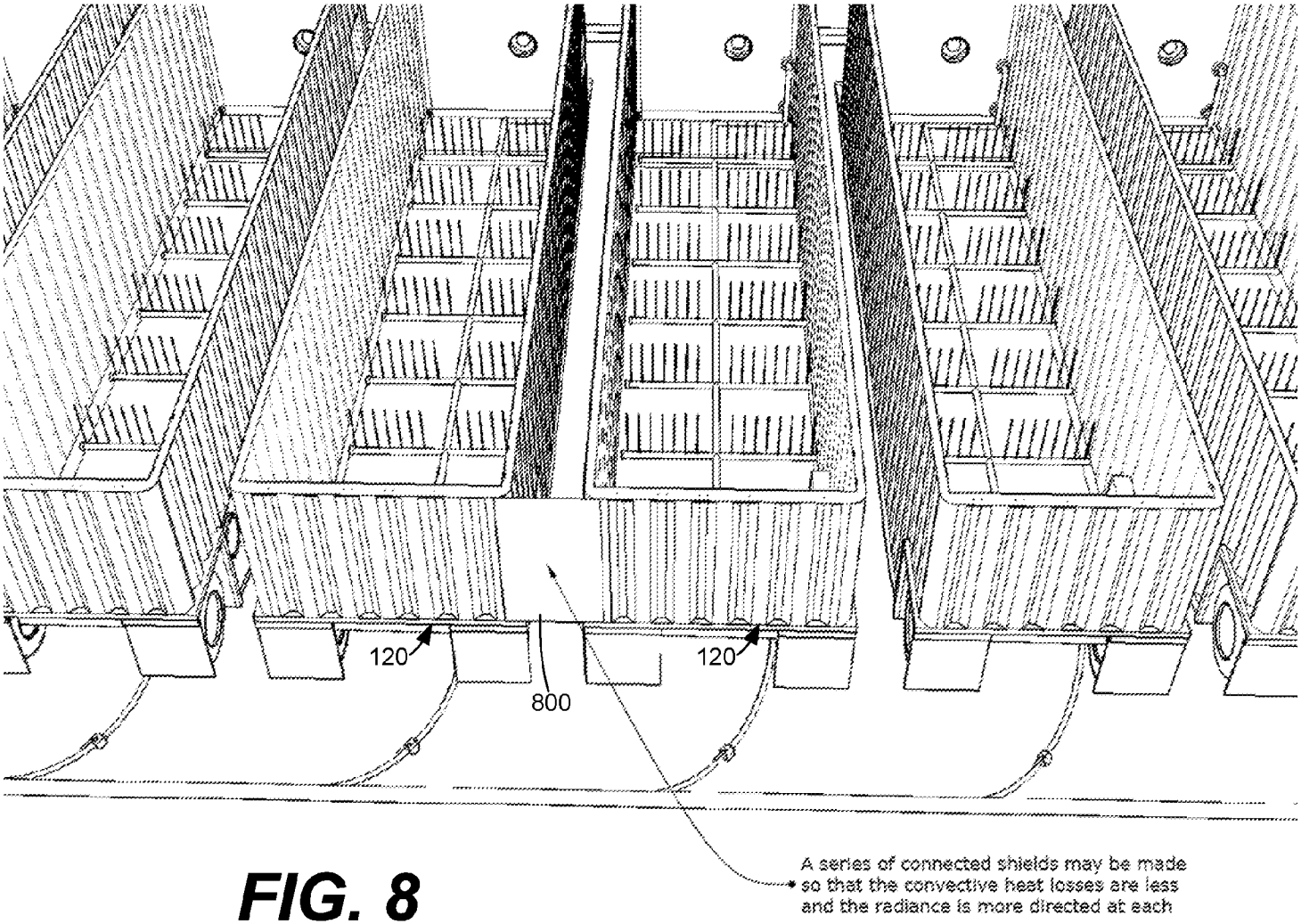
FIG. 8 illustrates a shield between two frac tank trailers according to one embodiment of the present disclosure.

FIG. 8 illustrates a shield 800 between two frac tank trailers 120 according to one embodiment of the present disclosure. The shield 800 may help prevent heat from radiating from the frac tank trailers 120, by preventing or reducing wind from circulating around the frac tank trailers 120. Shields similar to the shield 800 may be arranged and mounted between one or more pairs of the frac tank trailers 120, among embodiments, as desired. The shield 800 may be formed from metal, wood, plastic or any other suitable material and may be secured to the frac tank trailers 120 using magnets, mechanical fastening means (e.g., screws, bolts, etc.), hooks, or any other suitable fastening or affixing means. In other aspects of the embodiments, the frac tank trailers 120 may be insulated in other ways, including insulation wraps, jackets, and other coverings.

Figure 9:
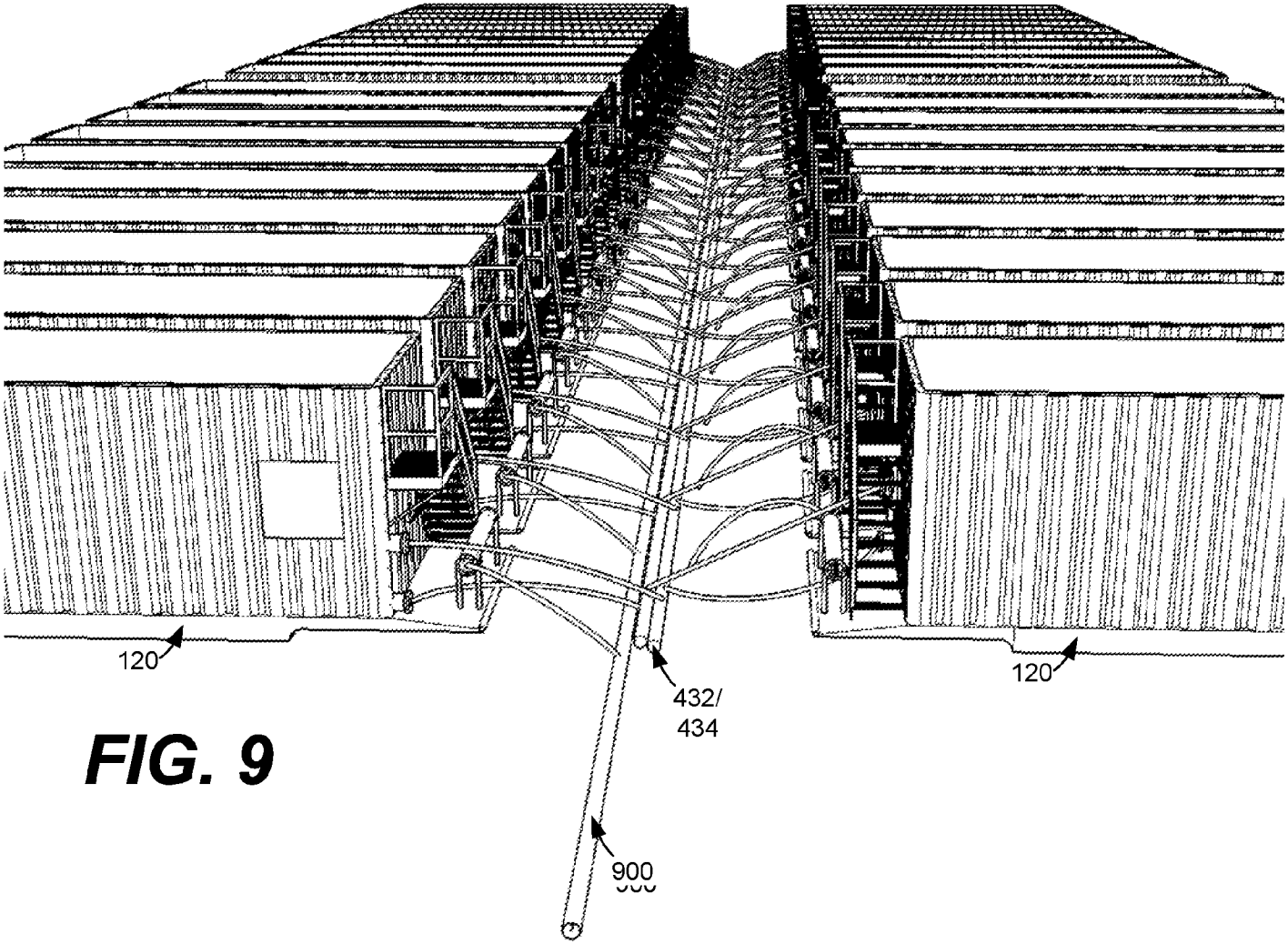
FIG. 9 illustrates a header pipe arrangement including an alternative drain header according to one embodiment of the present disclosure.

FIG. 9 illustrates a header pipe arrangement including an alternative drain header 900 according to one embodiment of the present disclosure. As illustrated in FIG. 9, the alternative drain header 900 is connected in fluid communication with an alternate drain, orifice, or opening of the frac tank trailers 120. In this context, it should be appreciated that the frac tank trailers 120 may be drained using one or more drain headers.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Therefore, the following is claimed:

1. A frac tank farm, comprising:

a heater;

at least one battery of frac tanks comprising a plurality of frac tank trailers;

at least one shield affixed between two of the plurality of frac tank trailers to avoid convective heat loss;

a header pipe arrangement that provides a fluid loop between the heater and the plurality of frac tank trailers, the header pipe arrangement comprising a header supply pipe to supply fluid heated by the heater to individual ones of the plurality of frac tank trailers and a header discharge pipe to discharge fluid from individual ones of the plurality of frac tank trailers to the heater; and a valve between at least one of the plurality of frac tank trailers and the header pipe arrangement.

2. The frac tank farm according to claim 1, wherein the header pipe arrangement further comprises a drain pipe to drain at least one of the plurality of frac tank trailers.

3. The frac tank farm according to claim 1, further comprising a pump in fluid communication with the header pipe arrangement to pump fluid through at least a portion of the header pipe arrangement.

4. The frac tank farm according to claim 1, wherein the header supply pipe comprises a first plurality of pipes that extend along the plurality of frac tank trailers, and the header discharge pipe comprises a second plurality of pipes that extend along the plurality of frac tank trailers.

5. The frac tank farm according to claim 1, wherein the header supply pipe comprises a plurality of supply pipes, the frac tank farm further comprising a plurality of connections that connect the plurality of supply pipes to the plurality of frac tank trailers, a restrictive orifice of individual ones of the plurality of connections having a predetermined size that causes a balanced flow of fluid through the individual ones of the plurality of connections to individual ones of the plurality of frac tank trailers based on the header pipe arrangement.

6. A frac tank farm, comprising:

a heater;

a plurality of batteries of frac tanks; and a header pipe arrangement that exchanges fluid between the heater and the plurality of batteries of frac tanks, the header pipe arrangement comprising a header supply pipe to supply fluid heated by the heater to at least one of the plurality of batteries and a header discharge pipe to discharge fluid from at least one of the plurality of batteries to the heater, wherein the header supply pipe comprises a first plurality of pipes that extend along the plurality of batteries, and the header discharge pipe comprises a second plurality of pipes that extend along the plurality of batteries; and a plurality of connections to the first plurality of pipes of the header supply pipe, a restrictive orifice of individual ones of the plurality of connections having a predetermined size that causes a balanced flow of fluid through the individual ones of the plurality of connections to individual ones of the plurality of batteries based on the header pipe arrangement.

7. The frac tank farm according to claim 6, wherein a head end of a first one of the plurality of batteries is positioned proximate to a tail end of a second one of the plurality of batteries.

8. The frac tank farm according to claim 6, wherein a head end of a first one of the plurality of batteries is positioned proximate to a head end of a second one of the plurality of batteries.

9. The frac tank farm according to claim 6, wherein individual ones of the first plurality of pipes of the header supply pipe are connected to the individual ones of the plurality of batteries through individual ones of a plurality of intake ports, individual ones of the second plurality of pipes of the header discharge pipe are connected to the individual ones of the plurality of batteries through individual ones of a plurality of output ports, and wherein the individual ones of the plurality of intake ports are positioned higher than the individual ones of the plurality of output ports on the individual ones of the plurality of batteries.

10. The frac tank farm according to claim 6, further comprising at least one shield affixed between two of the plurality of frac tanks to reduce wind circulation around the two of the plurality of frac tanks to prevent heat loss.

11. A frac tank farm, comprising:

a heater;

at least one battery of frac tanks comprising a plurality of frac tanks;

a header pipe arrangement that exchanges fluid between the heater and the plurality of frac tanks, the header pipe arrangement comprising a plurality of supply pipes to supply fluid heated by the heater to individual ones of the plurality of frac tanks and a plurality of discharge pipes to discharge fluid from individual ones of the plurality of frac tanks to the heater; and a plurality of connections that connect the plurality of supply pipes to the plurality of frac tanks, a restrictive orifice of individual ones of the plurality of connections having a predetermined size that causes a balanced flow of fluid through the individual ones of the plurality of connections to the individual ones of the plurality of frac tanks based on the header pipe arrangement.

12. The frac tank farm of claim 11, further comprising at least one shield affixed between two of the plurality of frac tanks to prevent heat loss.

* * * * *